US008243106B2

(12) United States Patent
Park et al.

(10) Patent No.: US 8,243,106 B2
(45) Date of Patent: Aug. 14, 2012

(54) DISPLAY DEVICE AND METHOD OF DRIVING THE SAME

(75) Inventors: Yun-Jae Park, Yongin-si (KR); Kyung-Uk Choi, Asan-si (KR); Hyun-Seok Ko, Seoul (KR)

(73) Assignee: Samsung Electronics Co., Ltd. (KR)

( * ) Notice: Subject to any disclaimer, the term of this patent is extended or adjusted under 35 U.S.C. 154(b) by 777 days.

(21) Appl. No.: 12/405,717

(22) Filed: Mar. 17, 2009

(65) Prior Publication Data

US 2010/0220108 A1 Sep. 2, 2010

(30) Foreign Application Priority Data

Mar. 17, 2008 (KR) ..... 10-2008-0024425

(51) Int. Cl.
*G09G 5/10* (2006.01)

(52) U.S. Cl. ..... 345/690; 345/82; 345/89

(58) Field of Classification Search ..... 345/76–82, 345/87–89, 102, 204, 690; 315/169.1–169.4
See application file for complete search history.

(56) References Cited

U.S. PATENT DOCUMENTS 7,432,881 B2 * 10/2008 Kawahaea et al. ..... 345/63
2005/0184952 A1 * 8/2005 Konno et al. ..... 345/102
2009/0015601 A1 * 1/2009 Kim ..... 345/690

FOREIGN PATENT DOCUMENTS

KR 1020060076043 A 7/2006
KR 1020070070915 A 7/2007
KR 1020070088148 A 8/2007

* cited by examiner

*Primary Examiner* — Kimnhung Nguyen
(74) *Attorney, Agent, or Firm* — Cantor Colburn LLP

(57) ABSTRACT

A display device includes; a signal control unit which receives a plurality of image signals and determines a plurality of representative image signals from the image signals, a plurality of lookup tables, each of which is configured to store a plurality of light data signals corresponding to the plurality of representative image signals, a plurality of light-emitting blocks configured to provide light according to the respective light data signals, and a display panel configured to display an image corresponding to the plurality of image signals, wherein the signal control unit determines an average luminance value of the plurality of image signals, selects one of the plurality of lookup tables according to the determined average luminance value, reads the light data signals from the selected lookup table and provides the light data signals to at least one of the plurality of light emitting blocks.

18 Claims, 11 Drawing Sheets

DISPLAY DEVICE AND METHOD OF DRIVING THE SAME

This application claims priority to Korean Patent Application No. 10-2008-0024425, filed on Mar. 17, 2008, and all the benefits accruing therefrom under 35 U.S.C. §119, the contents of which in its entirety are herein incorporated by reference.

BACKGROUND OF THE INVENTION

1. Field of the Invention

The present invention relates to a display device and a method of driving the same, and more particularly, to a display device having improved display quality and a method of driving the display device.

2. Description of the Related Art

A liquid crystal display ("LCD"), which is one of flat panel displays, includes a liquid crystal panel having a first substrate having a pixel electrode, a second substrate having a common electrode, and a liquid crystal layer disposed between the first and second substrate and having liquid crystal molecules having dielectric anisotropy to fill a predetermined gap therebetween. An electric field is created between the pixel electrode and the common electrode and a change in the strength of the electric field may change the orientation of the liquid crystal molecules, and thereby change the transmittance of light passing through the liquid crystal panel, thereby the LCD may display desired images. Since an LCD is not a self-luminescent display device, it includes a lighting apparatus, such as a plurality of light-emitting blocks, wherein the blocks may include a light emitting diode ("LED").

Recently, for display quality improvement, techniques for controlling the luminance for each of the light-emitting diodes according to an image displayed on a liquid crystal panel have been developed.

BRIEF SUMMARY OF THE INVENTION

The present invention provides a display device capable of improving display quality.

The present invention also provides a method of driving a display device capable of improving display quality.

The above and other aspects of the present invention will be described in or be apparent from the following description of the preferred embodiments.

According to an exemplary embodiment of the present invention, an exemplary embodiment of a display device includes; a signal control unit which receives a plurality of image signals and determines a plurality of representative image signals from the image signals, a plurality of lookup tables, each of which is configured to store a plurality of light data signals corresponding to the plurality of representative image signals, a plurality of light-emitting blocks configured to provide light according to the respective light data signals, and a display panel configured to display an image corresponding to the plurality of image signals, wherein the signal control unit determines an average luminance value of the plurality of image signals, selects one of the plurality of lookup tables according to the determined average luminance value, reads the light data signals from the selected lookup table and provides the light data signals to at least one of the plurality of light emitting blocks.

According to another exemplary embodiment of the present invention, an exemplary embodiment of a method of driving a display device includes; receiving a plurality of image signals and determining a plurality of representative image signals, providing a plurality of light data signals corresponding to the plurality of representative image signals according to an average luminance value of the plurality of image signals by selecting one of a plurality of lookup tables storing the plurality of light data signals corresponding to the plurality of representative image signals and reading the light data signals from the selected lookup table, driving a plurality of light blocks according to the respective light data signals, and displaying an image corresponding to the plurality of image signals.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
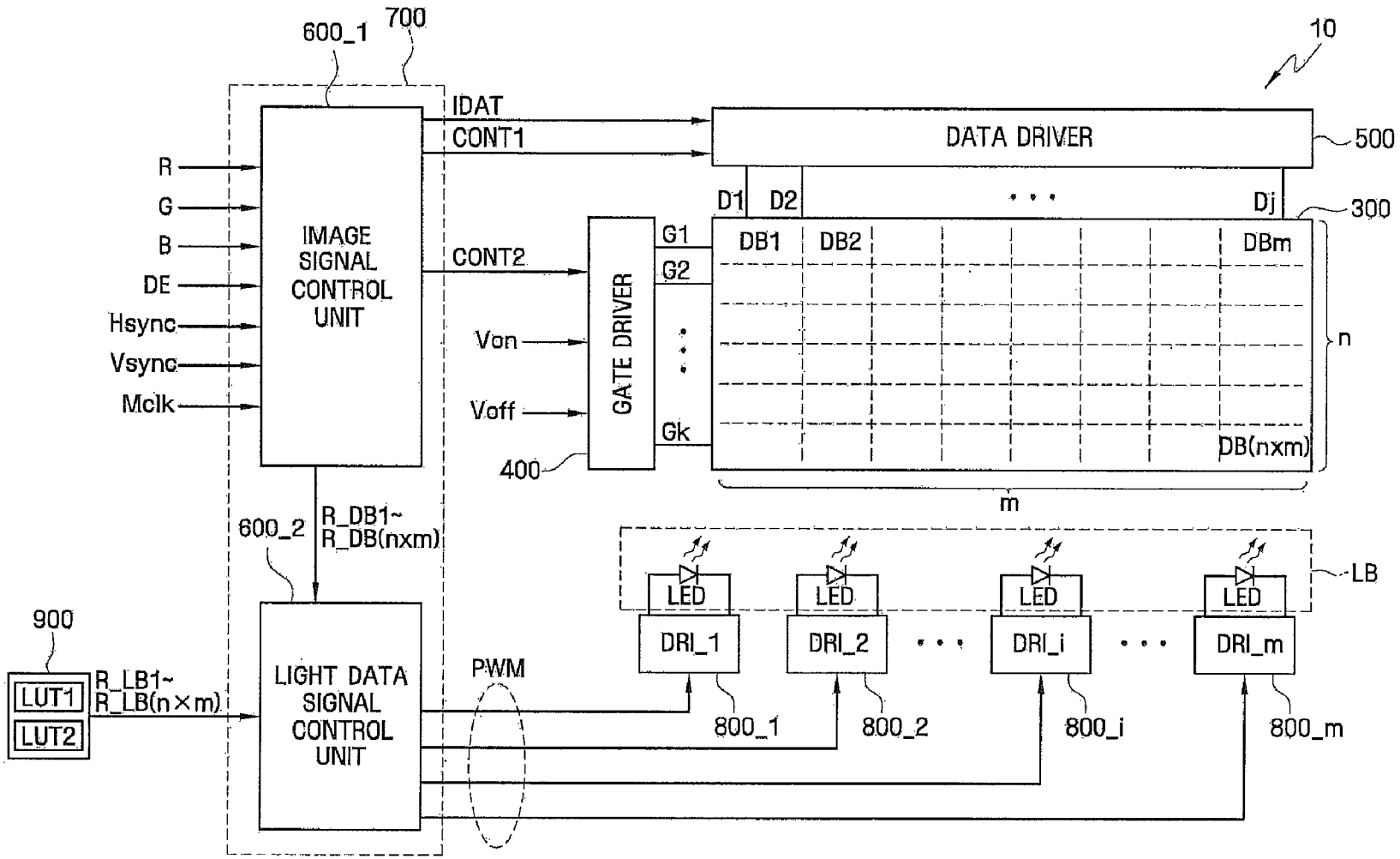
FIG. 1 is a block diagram illustrating a first exemplary embodiment of a liquid crystal display ("LCD") according to the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

While an exemplary embodiment of a liquid crystal display ("LCD") operates in a first operation mode and a second operation mode in the following description by way of example, alternative exemplary embodiments of the LCD may also operate only in the first operation mode or both in the first operation mode and in another operation mode that is not described below.

Figure 3:
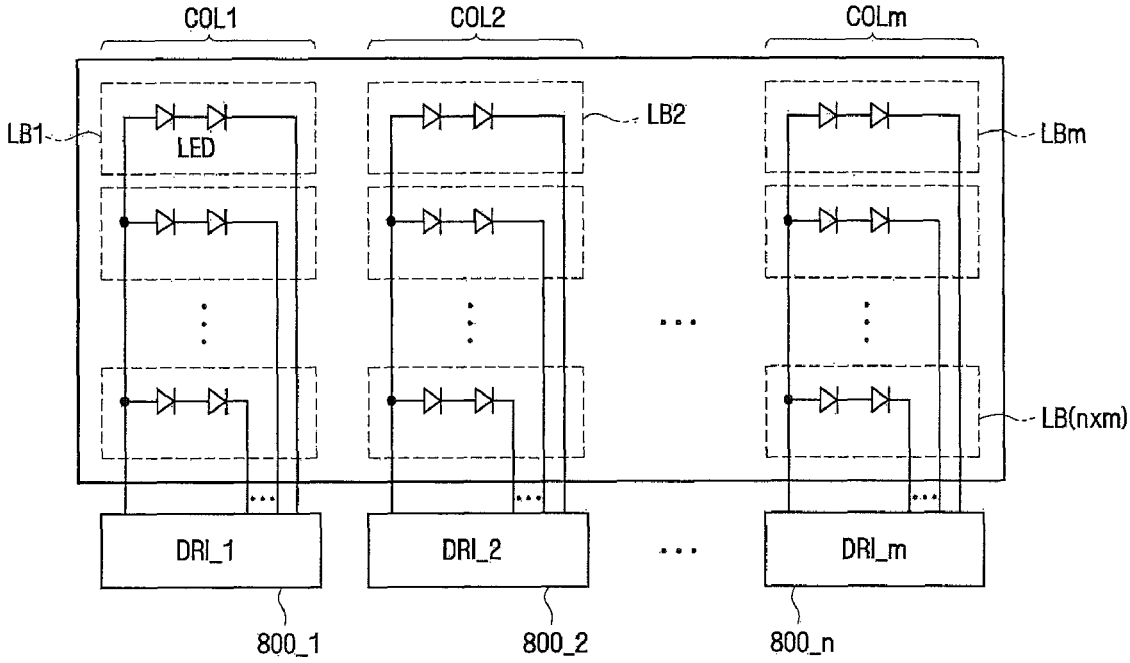
FIG. 3 is a block diagram illustrating an exemplary embodiment of an arrayed form of light-emitting blocks illustrated in FIG. 1 and a connected state of the light-emitting blocks and backlight drivers.
Figure 4:
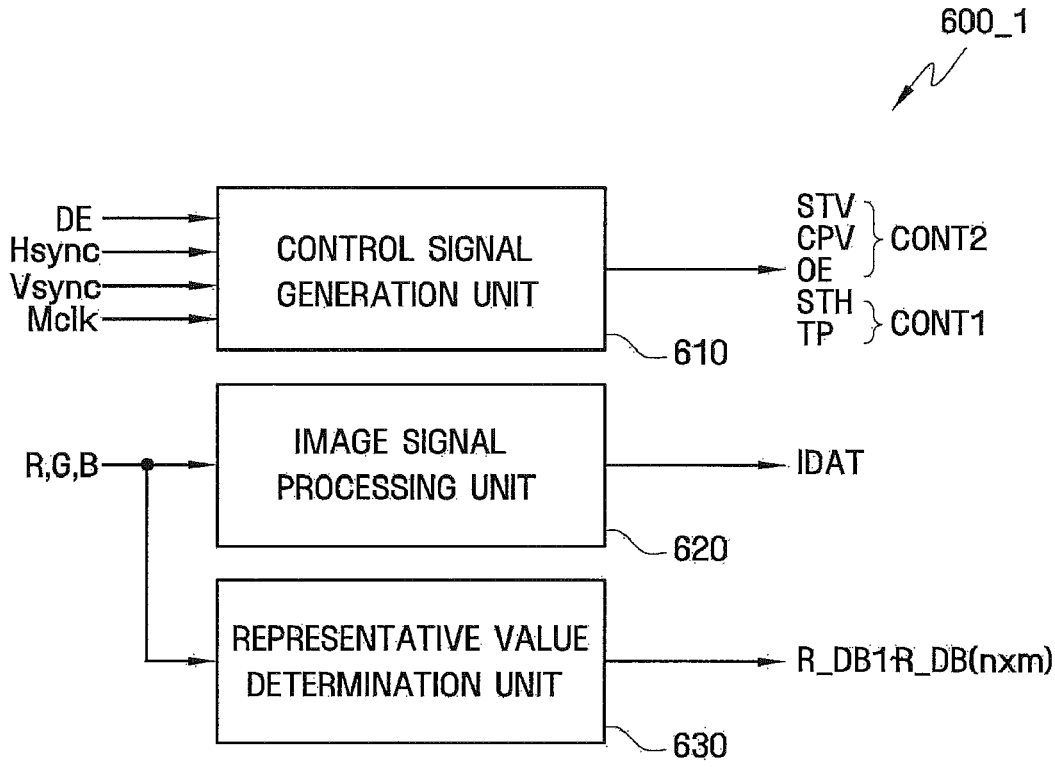
FIG. 4 is a block diagram of an exemplary embodiment of an image signal control unit illustrated in FIG. 1.
Figure 5:
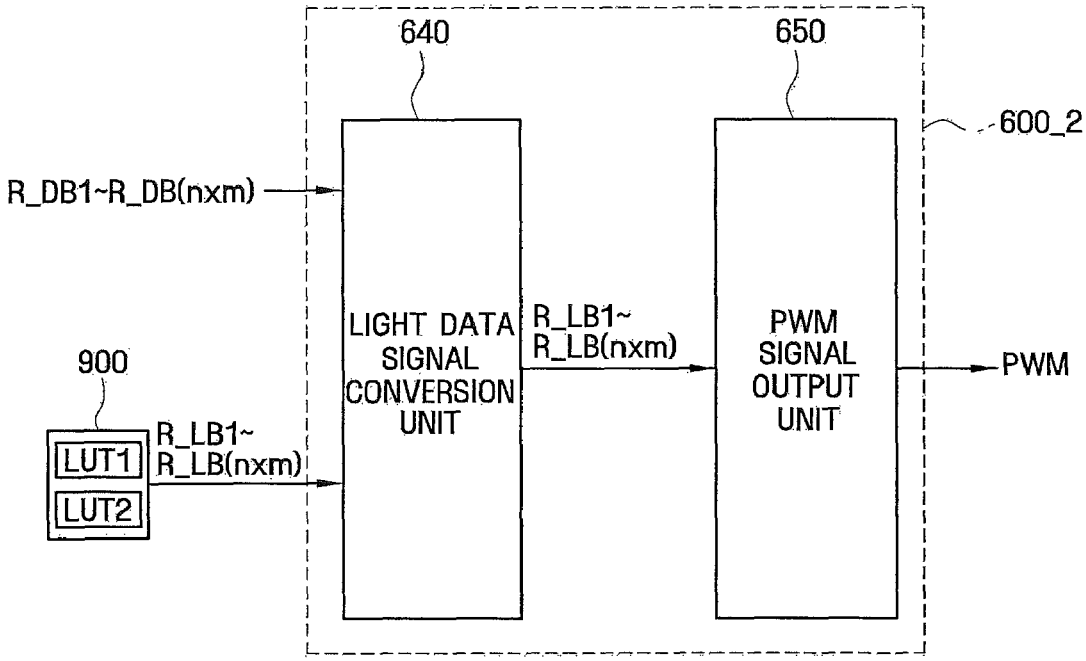
FIG. 5 is a block diagram of an exemplary embodiment of a light data signal control unit illustrated in FIG. 1.
Figure 6:
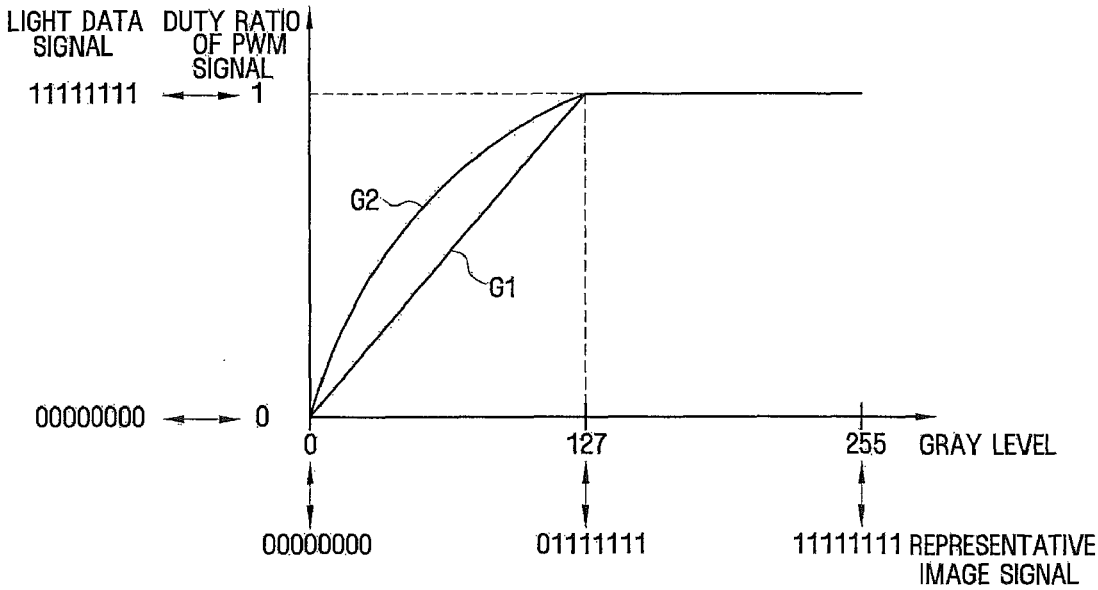
FIG. 6 is a graph illustrating light data signals stored in lookup tables of the light data signal control unit illustrated in FIG. 5.
Figure 7:
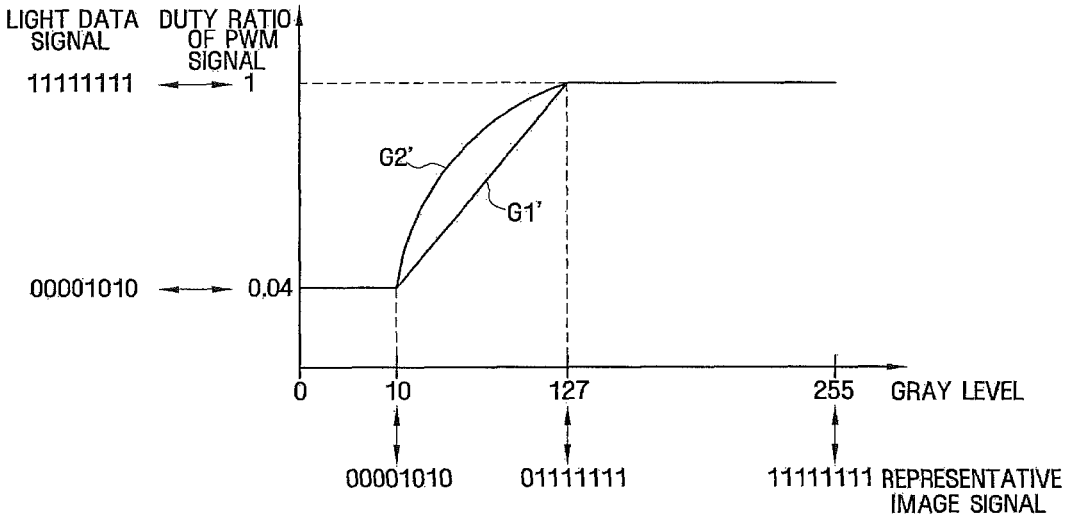
FIGS. 7 and 8 are graphs illustrating additional exemplary embodiments of the light data signal stored in the lookup tables of the light data signal control unit illustrated in FIG. 5.
Figure 8:
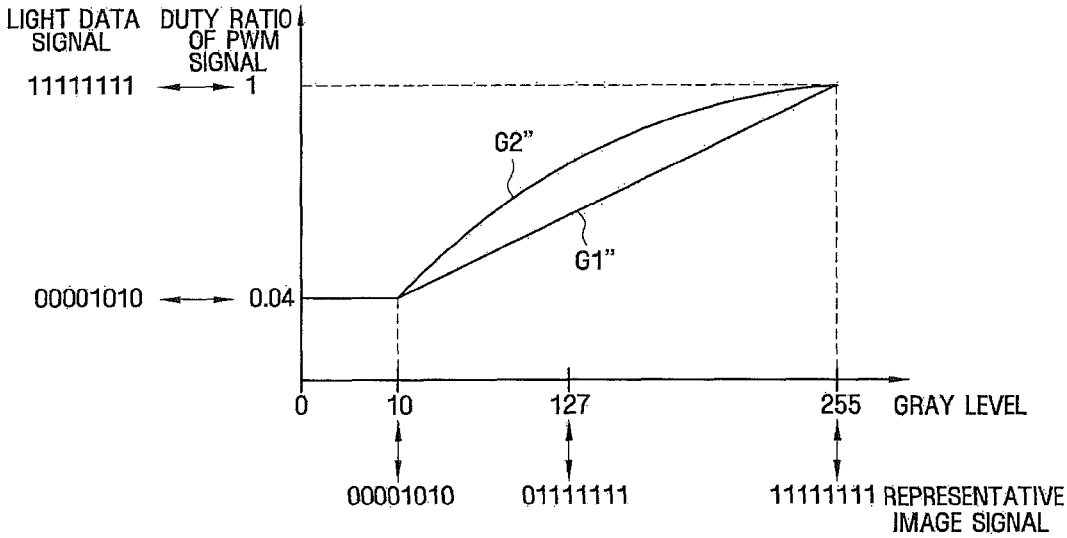

Hereinafter, a first exemplary embodiment of an LCD 10 and an exemplary embodiment of a method of driving the LCD 10 according to the present invention will be described with reference to FIGS. 1 through 8. FIG. 1 is a block diagram illustrating a first exemplary embodiment of liquid crystal display ("LCD") according to the present invention, FIG. 2 is an equivalent circuit diagram of a single pixel of the first exemplary embodiment of an LCD according to the present invention, FIG. 3 is a block diagram illustrating an exemplary embodiment of an arrayed form of light-emitting blocks illustrated in FIG. 1 and a connected state of the light-emitting blocks and backlight drivers, FIG. 4 is a block diagram of an exemplary embodiment of an image signal control unit illustrated in FIG. 1, FIG. 5 is a block diagram of an exemplary embodiment of a light data signal control unit illustrated in FIG. 1, FIG. 6 is a graph illustrating light data signals stored in lookup tables of the light data signal control unit illustrated in FIG. 5, and FIGS. 7 and 8 are graphs illustrating additional exemplary embodiments of the light data signal stored in the lookup tables of the light data signal control unit illustrated in FIG. 5.

Referring to FIG. 1, the LCD 10 includes a liquid crystal panel 300 including a plurality of data lines D1-Dj and a plurality of gate lines G1-Gk, a gate driver 400, a data driver 500, a signal control unit 700, first through $m^{th}$ backlight drivers 800_1-800_m, a plurality of light-emitting blocks LB which are connected to the first through mth backlight drivers 800_1-800_m, respectively, and a memory 900 which stores a first lookup table LUT1 and a second lookup table LUT2, wherein j, k and m are integers. The signal control unit 700 may be functionally divided into an image signal control unit 600_1 and a light data signal control unit 600_2. The image signal control unit 600_1 controls an image displayed on the liquid crystal panel 300, and the light data signal control unit 600_2 controls the first through mth backlight drivers 800_1-800_m. Exemplary embodiments include configurations wherein the image signal control unit 600_1 and the light data signal control unit 600_2 may also be physically divided.

The liquid crystal panel 300 may be divided into a plurality of display blocks DB1-DB(n×m). In one exemplary embodiment, the plurality of display blocks DB1-DB(n×m) may be arranged in the form of a (n×m) matrix to correspond to the plurality of light-emitting blocks LB, wherein n is an integer. In such an exemplary embodiment each of the display blocks DB1-DB(n×m) may include a plurality of pixels.

Figure 2:
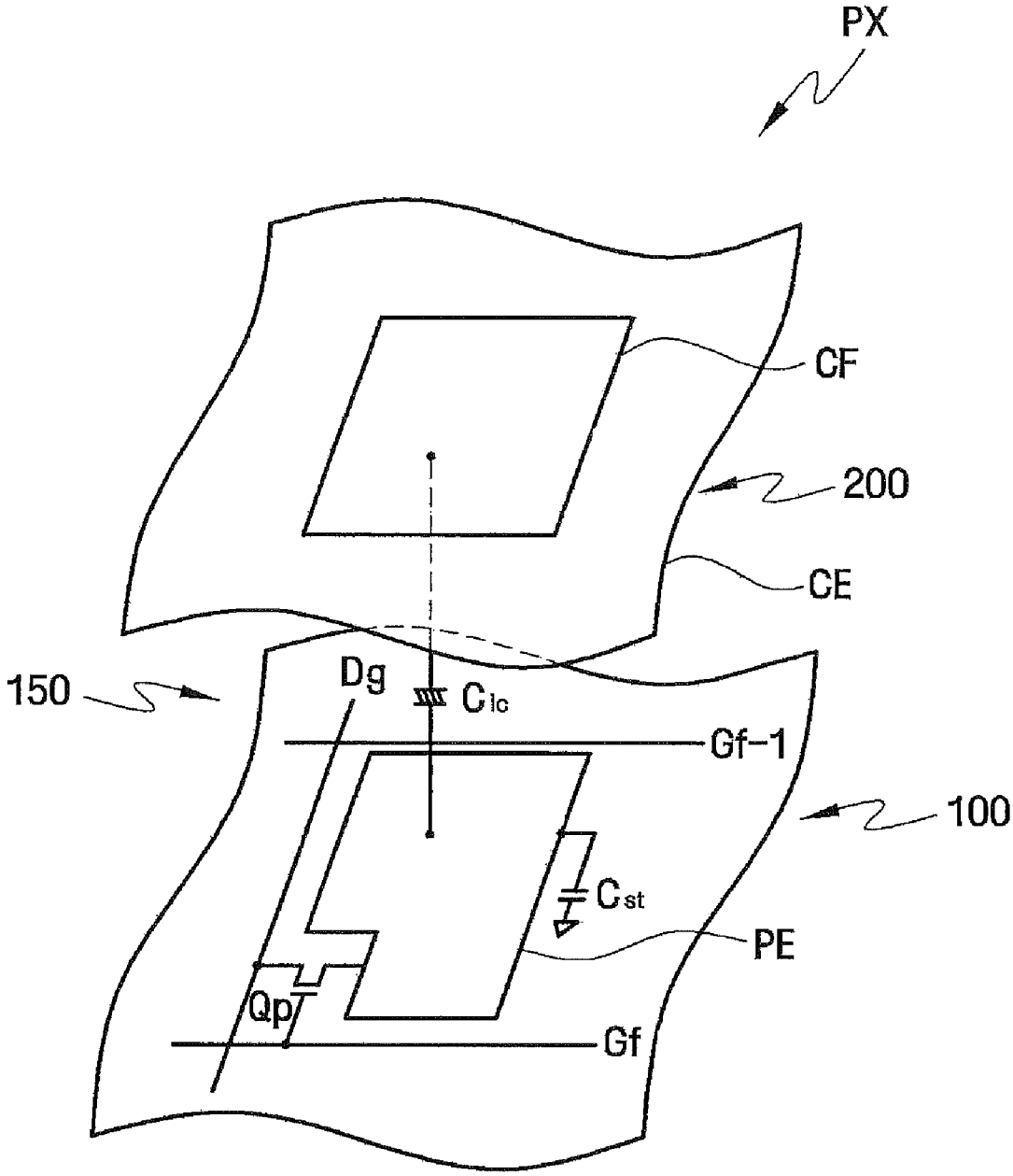
FIG. 2 is an equivalent circuit diagram of a single pixel of the first exemplary embodiment of an LCD according to the present invention.

FIG. 2 is an equivalent circuit diagram of a single pixel of the first exemplary embodiment of an LCD according to the present invention. A pixel, e.g., a pixel PX connected to an $f^{th}$ gate line Gf (wherein f may be an integer from 1-k) and a $g^{th}$ data line Dg (wherein g may be an integer from 1-j), includes a switching element Qp connected to the gate line Gf and the data line Dg and a liquid crystal capacitor $C_{lc}$ and a storage capacitor $C_{st}$ connected to the switching element Qp. The liquid crystal capacitor $C_{lc}$ includes a pixel electrode PE of a first display panel 100 and a common electrode CE of a second display panel 200. A color filter CF is formed on at least a portion of the common electrode CE.

The signal control unit 700 receives red, green, and blue image signals R, G and B, respectively, and external control signals Vsync, Hsync, Mclk, and DE, for controlling display of the image signals R, G and B, and outputs an image data signal IDAT, a data control signal CONT1, a gate control signal CONT2, and pulse width modulation ("PWM") signals PWM. According to the current exemplary embodiment, the signal control unit 700 may output the PWM signals PWM according to images displayed by the display blocks DB1-DB(n×m).

In more detail, the image signal control unit 600_1 receives the external control signals Vsync, Hsync, Mclk, and DE and generates the data control signal CONT1 and the gate control signal CONT2. Examples of the external control signals Vsync, Hsync, Mclk, and DE include a vertical synchronization signal Vsync, a horizontal synchronization signal Hsync, a main clock signal MCLK, and a data enable signal DE. According to the current exemplary embodiment, the data control signal CONT1 controls the operation of the data driver 500, and the gate control signal CONT2 controls the operation of the gate driver 400.

In addition, the image signal control unit 600_1 receives the image signals R, G and B and outputs an image data signal IDAT and representative image signals R_DB1-R_DB(n×m). According to the current exemplary embodiment, the image data signal IDAT may be a signal converted from the image signals R, G and B for improving the response speed and/or display quality. Exemplary embodiments also include configurations wherein the image data signal IDAT may be a signal that is substantially the same as the image signals R, G and B. Each of representative image signals R_DB1-R_DB (n×m) may be a representative value of the image signals R, G and B provided to each of the display blocks DB1-DB(n×m), e.g., an average value of the image signals R, G and B provided to each of the display blocks DB1-DB(n×m). The operation and internal structure of the image signal control unit 600_1 will be described in more detail with reference to FIG. 4.

The light data signal control unit 6002, provided with the representative image signals R_DB1-R_DB(n×m), selects a lookup table from one of the first lookup table LUT1 and the second lookup table LUT2, reads light data signals R_LB1-R_LB(n×m) corresponding to the representative image signals R_DB1-R_DB(n×m) from the selected lookup table, and outputs the PWM signals PWM corresponding to the light data signals R_LB1-R_LB(n×m) to the first through $m^{th}$ backlight drivers 800_1-800_m.

More specifically, in the current exemplary embodiment the light data signal control unit 600_2, provided with the representative image signals R_DB1-R_DB(n×m), determines an average luminance value of the image signals R, G and B, and selects a lookup table from one of the first lookup table LUT1 and the second lookup table LUT2 according to the determined average luminance value. The first lookup table LUT1 and the second lookup table LUT2 may store different light data signals R_LB1-R_LB(n×m) corresponding to the representative image signals R_DB-R_DB(n×m). In one exemplary embodiment, each of the first lookup table LUT1 and the second lookup table LUT2 may store light data signals R_LB1-R_LB(n×m) corresponding to a margin gray level for representative image signals R_DB1-R_DB(n×m) having lower gray levels than a predetermined gray level. A margin gray level as used herein, is a predetermined gray level which serves as an artificial boundary below which all gray levels will be mapped to the same light data signal and thus, the same PWM duty ratio. Thus, the light data signal control unit 600_2 may receive the representative image signals R_DB1-R_DB(n×m) having lower gray levels than the predetermined margin gray level and output the light data signals R_LB1-R_LB(n×m) corresponding to the margin gray level. The operation and internal structure of the light data signal control unit 600_2 will be described with reference to FIGS. 5 through 7.

Meanwhile, the gate driver 400, provided with the gate control signal CONT2 from the image signal control unit 600_1, applies a gate signal to the gate lines G1-Gk. Here, the gate signal is composed of a combination of a gate-on voltage Von and a gate-off voltage Voff, which may be generated from a gate on/off voltage generator (not shown). The gate control signal CONT2 for controlling the operation of the gate driver 400 may include a vertical synchronization start signal instructing start of the operation of the gate driver 400, a gate clock signal controlling an output timing of the gate on signal, an output enable signal that determines the duration of the gate-on voltage Von, and various other signals as known in the art.

The data driver 500, provided with the data control signal CONT1 from the image signal control unit 600_1, applies a voltage corresponding to the image data signal IDAT to the data lines D1-Dj. The data control signal CONT1 includes signals for controlling the operation of the data driver 500. The signals for controlling the operation of the data driver 500 may include a horizontal synchronization start signal for starting the operation of the data driver 500, an output enable signal that determining the output of an image data voltage, and various other signals as known in the art.

Each of the backlight drivers 800_1-800_m controls a luminance value of each of the light-emitting blocks LB1-LB (n×m) in response to the PWM signal PWM. In one exemplary embodiment, the plurality of light-emitting blocks LB1-LB(n×m) may be arrayed, for example, as illustrated in FIG. 3. In other words, the plurality of light-emitting blocks LB1-LB(n×m) may be arrayed in the form of a (n×m) matrix to correspond to the plurality of display blocks DB1-DB(n×m). Each of the light emitting blocks LB1-LB(n×m) includes at least one light emitting element, e.g., at least one light emitting diode ("LED"). In one exemplary embodiment, the number of backlight drivers 800_1-800_m may be m in total and each of the backlight drivers 800_1-800_m may be connected to each of columns COL1-COLm, each column COL1-COLm having n light-emitting blocks, to control a luminance value of each of the light-emitting blocks LB1-LB (n×m).

Although the present exemplary embodiments describe the number of light-emitting blocks LB1-LB(n×m) as equaling the number of display blocks DB1-DB(n×m), alternative exemplary embodiments include configurations wherein the number of light-emitting blocks may differ from the number of display blocks.

An exemplary embodiment of the image signal control unit 600_1 illustrated in FIG. 1 will now be described in detail with reference to FIG. 4. The image signal control unit 600_1 illustrated in FIG. 4 may include a control signal generation unit 610, an image signal processing unit 620, and a representative value determination unit 630.

In the current exemplary embodiment, the control signal generation unit 610 receives the external control signals Vsync, Hsync, Mclk, and DE and outputs the data control signal CONT1 and the gate control signal CONT2. In detail, exemplary embodiments include configurations wherein the control signal generation unit 610 may generate various signals, such as a vertical start signal STV for starting the operation of the gate driver 400 shown in FIG. 1, a gate clock CPV for determining an output time of the gate-on voltage Von, a gate output enable signal OE for determining a pulse width of the gate-on voltage Von, a horizontal synchronization start signal STH for starting the operation of the data driver 500 shown in FIG. 1, and an output instruction signal TP for instructing the output of an image data voltage.

The image signal processing unit 620 may receive the image signals R, G and B and output the image data signal IDAT. The image signal processing unit 620 may convert the image signals R, G and B into the image data signal IDAT and output the image data signal IDAT to improve response time and display quality. As mentioned above, alternative exemplary embodiments include configurations wherein the image signal processing unit 620 does not convert the image signals R, G and B to improve response time and display quality. In such an alternative exemplary embodiment, the image signal processing unit 620 may output the image signals R, G and B.

The representative value determination unit 630 determines the representative image signals R_DB1-R_DB(n×m) corresponding to the display blocks DB1-DB(n×m). For example, the representative value determination unit 630 may receive the image signals R, G and B and determine the representative image signals R_DB1-R_DB(n×m). Each of the representative image signals R_DB1-R_DB(n×m) may be an average value of the image signals R, G and B provided to each of the display blocks DB1-DB(n×m). Thus, each of the representative image signals R_DB1-R_DB(n×m) may indicate an average luminance value of each of the display blocks DB1-DB(n×m) or a gray level of each of the display blocks DB1-DB(n×m). Unlike the exemplary embodiment illustrated in FIG. 4, alternative exemplary embodiments of the representative value determination unit 630 may determine the representative image signals R_DB1-R_DB(n×m) of the display blocks DB1-DB(n×m) by using the image data signal IDAT. In such an alternative exemplary embodiment, the representative value determination unit 630 would perform the same determination of average luminance value of the image data signal IDAT provided to each of the display blocks DB1-DB(n×m), and would output each of the representative image signals R_DB1-R_DB(n×m) accordingly.

Hereinafter, an exemplary embodiment of the light data signal control unit 600_2 illustrated in FIG. 1 will be described in detail with reference to FIGS. 5 through 7. Referring to FIG. 5, the light data signal control unit 600_2 includes a light data signal conversion unit 640 and a PWM signal output unit 650.

The light data signal conversion unit 640 receives the plurality of representative image signals R_DB1-R_DB(n×m) and determines an average luminance value of the image signals R, G and B, e.g., an average luminance value of a single frame. For example, since the representative image signals R_DB1-R_DB(n×m) are average luminance values of the display blocks DB1-DB(n×m), the light data signal conversion unit 640 may calculate an average luminance value of a single frame by averaging the representative image signals R_DB1-R_DB(n×m).

The light data signal conversion unit 640 selects one of a plurality of lookup tables (in the exemplary embodiment shown in FIGS. 1 and 5, there are two lookup tables LUT1 and LUT2, however, alternative exemplary embodiments may include additional lookup tables) from the memory 900 according to the determined average luminance value. The light data signal conversion unit 640 reads the light data signals R_LB1-R_LB(n×m) corresponding to the representative image signals R_DB1-R_DB(n×m) from the selected lookup table and outputs the read light data signals to the PWM signal output unit 650.

Hereinafter, the light data signals R_LB1-R_LB(n×m) stored in each of the first lookup table LUT1 and the second lookup table LUT2 will be described with reference to FIG. 6. Although the light data signal conversion unit 640 converts the representative image signals R_DB1-R_DB(n×m) into the light data signals R_LB1-R_LB(n×m) by using two lookup tables (LUT1 and LUT2), additional lookup tables may also be used.

Referring to FIG. 6, an x-axis indicates the representative image signals R_DB1-R_DB(n×m) and gray levels and a y-axis indicates duty ratios of PWM signals PWM and the light data signals R_LB1-R_LB(n×m). As mentioned previously, since the representative image signals R_DB1-R_DB (n×m) indicates respective average luminance (gray) levels of the display blocks DB1-DB(n×m), the representative image signals R_DB1-R_DB(n×m) may correspond to gray levels as illustrated in FIG. 6. Since the light data signals R_LB1-R_LB(n×m) are converted into the PWM signals PWM by the PWM signal output unit 650, the light data signals R_LB1-R_LB(n×m) may correspond to the duty ratios of the PWM signals PWM as illustrated in FIG. 6. A first gamma curve G1 and a second gamma curve G2 are functions for mapping the representative image signals R_DB1-R_DB(n×m) to the light data signals R_LB1-R_LB(n×m). In other words, the light data signals R_LB1-R_LB(n×m) corresponding to the representative image signals R_DB1-R_DB(n×m), as derived from the first gamma curve G1, are stored in the first lookup table LUT1, and the light data signals R_LB1-R_LB(n×m) corresponding to the representative image signals R_DB1-R_DB(n×m), as derived from the second gamma curve G2, are stored in the second lookup table LUT2. As mentioned above, alternative exemplary embodiments include configurations wherein additional lookup tables may be used, such additional lookup tables may include light data signals R_LB1-R_LB(n×m) corresponding to the representative image signals R_DB1-R_DB(n×m), as derived from additional gamma curves.

When the gray levels of the representative image signals R_DB1-R_DB(n×m) are between 127 and 255, the first gamma curve G1 and the second gamma curve G2 map the representative image signals R_DB1-R_DB(n×m) to the same light data signal, e.g., "11111111." When the gray levels of the representative image signals R_DB1-R_DB(n×m) are between 0 and 127, the first gamma curve G1 and the second gamma curve G2 map the representative image signals R_DB1-R_DB(n×m) to different light data signals. However, the first gamma curve G1 and the second gamma curve G2 described above are only examples and may be set to be different from the above examples as will be illustrated in more detail in FIGS. 7 and 8.

When an average luminance value of the representative image signals R_DB1-R_DB(n×m) is higher than a predetermined reference luminance value, the light data signal conversion unit 640 selects the first lookup table LUT1. When the average luminance value of the representative image signals R_DB1-R_DB(n×m) is smaller than the predetermined reference luminance value, the light data signal conversion unit 640 selects the second lookup table LUT2. As illustrated in FIG. 6, when the gray levels of the representative image signals R_DB1-R_DB(n×m) are smaller than 127, the duty ratio of the PWM signal PWM corresponding to each of the representative image signals R_DB1-R_DB(n×m) derived from the first gamma curve G1, is less than the duty ratio of the PWM signal PWM corresponding to each of the representative image signals R_DB1-R_DB(n×m) derived from the second gamma curve G2. As the duty ratio of the PWM signal PWM increases, a luminance value of light emitted from each of the light-emitting blocks LB1-LB(n×m) increases. Thus, when the representative image signals R_DB1-R_DB(n×m) correspond to the light data signals R_LB1-R_LB(n×m) derived from the second gamma curve G2, the overall luminance of the light-emitting blocks LB1-LB(n×m) is improved compared to a case where the representative image signals R_DB1-R_DB(n×m) correspond to the light data signals R_LB1-R_LB(n×m) derived from the first gamma curve G1.

In an image where relatively small bright portions are displayed on a large dark background, i.e., wherein the overall luminance value is relatively low, for example, the display of stars in a night sky, an average luminance value of image signals R, G and B of the image is very low. In this case, if the luminance values of the light-emitting blocks LB1-LB(n×m) are reduced according to an average luminance value of the image signals R, G and B or the image data signal IDAT, the bright portions of the display cannot be clearly seen against the dark background. When the average luminance value of the image signals R, G and B is smaller than a predetermined reference luminance value, the white dots can be displayed by increasing the luminance values of the light-emitting blocks LB1-LB(n×m), thereby improving display quality.

However, in a case where an image has a relatively even ratio between bright and dark portions, i.e., wherein the overall luminance value is average, or in a case wherein an image has a large ratio of bright portions, i.e., wherein the overall luminance value is larger than average, an average luminance value of image signals R, G and B is either average or large, respectively. In such cases, the gamma curve G1 may be selected to provide a more constant brightness variation to the luminance values of the light-emitting blocks LB1-LB(n×m).

To sum up, the average luminance value of the image signals R, G and B is determined by using the plurality of representative image signals R_DB1-R_DB(n×m). The light data signal conversion unit 600_2 selects the first lookup table LUT1 when the average luminance value is higher than the predetermined reference luminance value, and selects the second lookup table LUT2 when the average luminance value is smaller than the predetermined reference luminance value. The light data signal conversion unit 600_2 then reads the light data signals R_LB1-R_LB(n×m) corresponding to the representative image signals R_DB1-R_DB(n×m). For a given representative image signal, a light data signal of the second lookup table LUT2 has a gray level higher than or equal to that of the first lookup table LUT1. Thus, when the light data signal conversion unit 640 selects the second lookup table LUT2 to output the light data signals R_LB1-R_LB(n×m), the luminance values of the light-emitting blocks LB1-LB(n×m) corresponding to representative image signals R_DB1-R_DB(n×m) having a gray level less than 127, are increased, compared to a case where the light data signal conversion unit 640 selects the first lookup table LUT1 to output the light data signals R_LB1-R_LB(n×m), thereby improving display quality.

FIG. 7 illustrates another exemplary embodiments of a first gamma curve G1' and a second gamma curve G2' that are different than those illustrated in FIG. 6. The light data signals R_LB1-R_LB(n×m) corresponding to the representative image signals R_DB1-R_DB(n×m) are stored in the first lookup table LUT1 based on the first gamma curve G1' and the light data signals R_LB1-R_LB(n×m) corresponding to the representative image signals R_DB1-R_DB(n×m) are stored in the second lookup table LUT2 based on the second gamma curve G2'. In the present exemplary embodiment, the first gamma curve G1' and the second gamma curve G2' map gray levels between 0 and 10 to a PWM signal duty ratio of 0.04, map gray levels between 10 and 127 to different PWM signal duty ratios, and map gray levels higher than 127 to a PWM signal duty ratio of 1.

If the gray level of a representative image signal "00001010" is equal to a margin gray level, e.g., 10, the representative image signal "00001010" corresponds to a light data signal "00001010" corresponding to a PWM signal duty ratio of 0.04. If the gray level of a representative image signal is lower than the margin gray level, the representative image signal corresponds to the light data signal "00001010." In other words, the light data signal conversion unit 640 outputs a light data signal corresponding to a margin gray level if the gray level of a representative image signal is lower than the margin gray level. Essentially, the establishment of a margin gray level for the gamma curves G1' and G2' sets a lower limit for the duty ratio of the PWM signal PWM. In the exemplary embodiment shown in FIG. 7, the lower limit for the duty ratio of the PWM signal PWM is 0.04, however alternative exemplary embodiments may include other lower limits for the PWM signal PWM.

Manufacturing differences in the plurality of LEDs lead to variations in the amount of time it takes for an individual LED to be turned on/off. For this reason, for a very small duty ratio of a PWM signal PWM, e.g., a duty ratio less than 0.04, the LEDs may be individually flickered without all being turned on/off. However, such a problem can be overcome by not reducing a PWM signal duty ratio to less than 0.04, even when the gray level of a representative image signal is lower than a margin gray level of 10. In one exemplary embodiment, the margin gray level corresponds to a minimum PWM signal duty ratio in which flickering of each LED is not sensed, and can be derived experimentally.

FIG. 8 illustrates another exemplary embodiment of a first gamma curve G1" and a second gamma curve G2" that are different than those illustrated in FIGS. 6 and 7. The light data signals R_LB1-R_LB(n×m) corresponding to the representative image signals R_DB1-R_DB(n×m), as derived from the first gamma curve G1", are stored in the first lookup table LUT1 and the light data signals R_LB1-R_LB(n×m) corresponding to the representative image signals R_DB1-R_DB (n×m), as derived from the second gamma curve G2", are stored in the second lookup table LUT2. In the present exemplary embodiment, the first gamma curve G1" and the second gamma curve G2" map gray levels between 0 and 10 to a PWM signal duty ratio of 0.04, map gray levels between 10 and 255 to different PWM signal duty ratios, and map gray levels higher than 255 to a PWM signal duty ratio of 1.

When a representative image signal has a low gray level, e.g., a gray level lower than a margin gray level of 10, the representative image signal corresponds to a PWM signal duty ratio of 0.04, thereby reducing flickering of each LED, as has been discussed previously. When the gray level of a representative image signal is between 10 and 255, the representative image signal corresponds to different PWM signal duty ratios, thereby improving display quality.

While three exemplary embodiments of different gamma curves have been described, a wide variation of gamma curves wherein at least one portion of the first lookup table LUT1 and the second lookup table LUT2 may store different light data signals R_LB1-R_LB(n×m) according to an average luminance value of the representative image signals R_DB1-R_DB(n×m), or in an alternative exemplary embodiment the image data signal IDAT, may be used without being limited to the first and second gamma curves G1, G2, G1', G2', G1", and G2".

The PWM signal output unit 650 receives the light data signals R_LB1-R_LB(n×m) and outputs the PWM signals PWM corresponding to the light data signals R_LB1-R_LB (n×m).

The operations of the backlight drivers 800_1-800_m and the light-emitting blocks LB1-LB(n×m) illustrated in FIG. 1 will be described with reference to FIGS. 3 and 9. For convenience of explanation, the first backlight driver 800_1 and light-emitting blocks LB in a first column COL1 connected to the first backlight driver 800_1 will be described by way of example.

Figure 9:
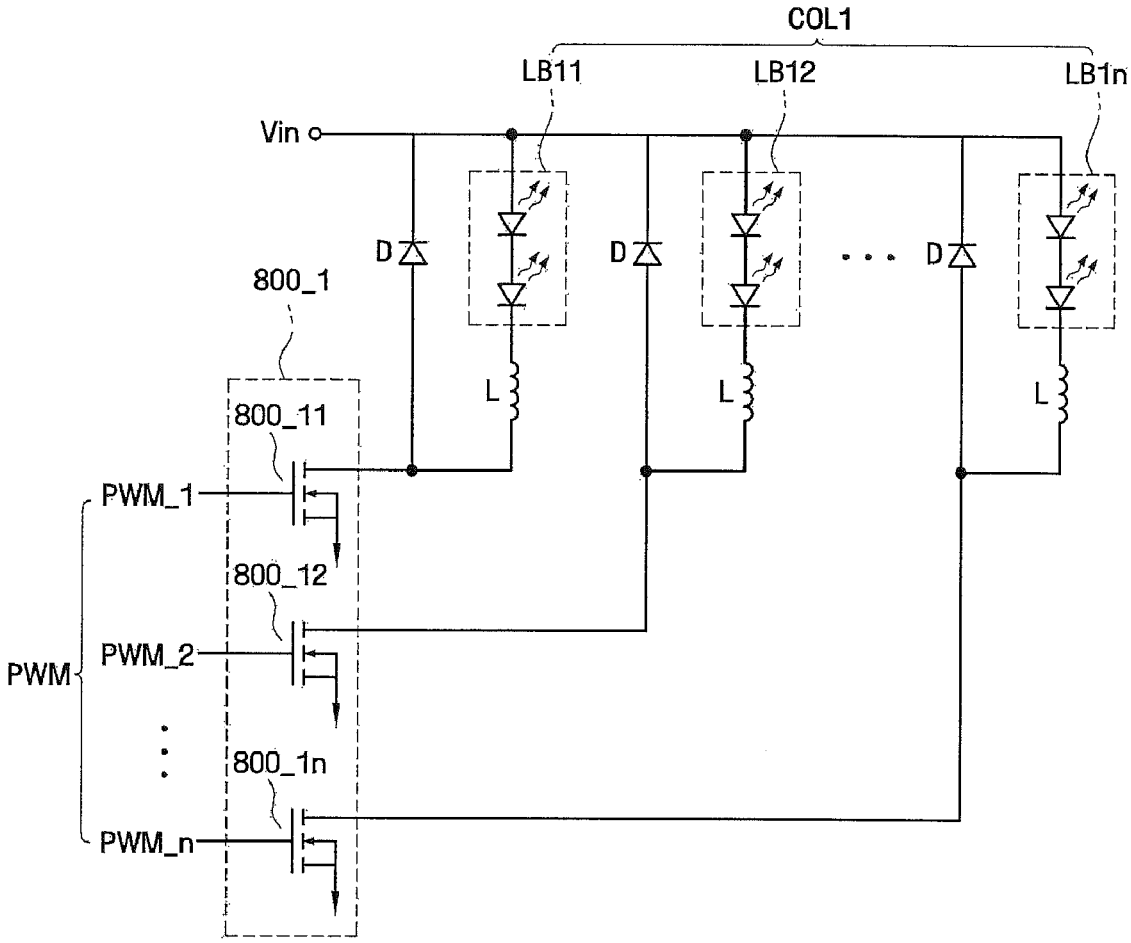
FIG. 9 is an equivalent circuit diagram of an exemplary embodiment of a backlight driver illustrated in FIG. 1.

Referring to FIGS. 3 and 9, the first backlight driver 800_1 includes a plurality of switching elements 800_11-800_1*n* and controls the luminance values of the light-emitting blocks in a first column COL1 in response to a PWM signal PWM. Once the switching elements 800_11-800_1*n* of the first backlight driver 800_1 are turned on by receiving a PWM signal PWM of a high level, a power voltage Vin is provided to the light-emitting blocks LB in the first column COL1 and thus current flows through the light-emitting blocks LB in the first column COL1 and inductors L. Light is emitting from the light-emitting blocks LB as current flows therethrough. At this time, the inductors L store energy corresponding to the current. When the PWM signal PWM switches to a low level, the switching elements 800_11-800_1*n* are turned off, and each of the light-emitting blocks LB in the first column COL1, each of the inductors L, and each of diodes D form a closed circuit. Due to the energy stored in the inductors L, current may still flow through the light-emitting blocks LB, and therefore the light-emitting blocks LB continue to emit light. Over a period of time, the energy stored in the inductors L is discharged and thus current is reduced, resulting in diminished light emission from the light-emitting block LB. Since a time during which the switching elements 800_11-800_1*n* are turned on is controlled according to a duty ratio of the PWM signal PWM, the luminance value of each of the light-emitting blocks LB in the first column COL1 is controlled according to the duty ratio of the PWM signal PWM applied to the switching element 800_11-800_1*n*, respectively.

The same, or similar, procedure may be applied to each of the backlight drivers 800_1-800_m, with each backlight driver receiving PWM signals PWM_1-PWM_n. Thereby, the luminance of each light emitting block LB(n×m) may be individually controlled.

However, in an alternative exemplary embodiment, the PWM signal output unit 650 illustrated in FIG. 5 may be included in each of the backlight drivers 800_1-800_m. In this case, the light data signal control unit 6002 may not include the PWM signal output unit 650, and may output the light data signals R_LB1-R_LB(n×m) to the backlight drivers 800_1-800_m. In one exemplary embodiment, the light data signal control unit 600_2 may output the light data signals R_LB1-R_LB(n×m) to the backlight drivers 800_1-800_m through a serial interface. The backlight drivers 800_1-800_m may receive the light data signals R_LB1-R_LB(n×m) and convert the light data signals R_LB1-R_LB(n×m) into the PWM signals PWM to control the light-emitting blocks LB1-LB(n×m).

Figure 10:
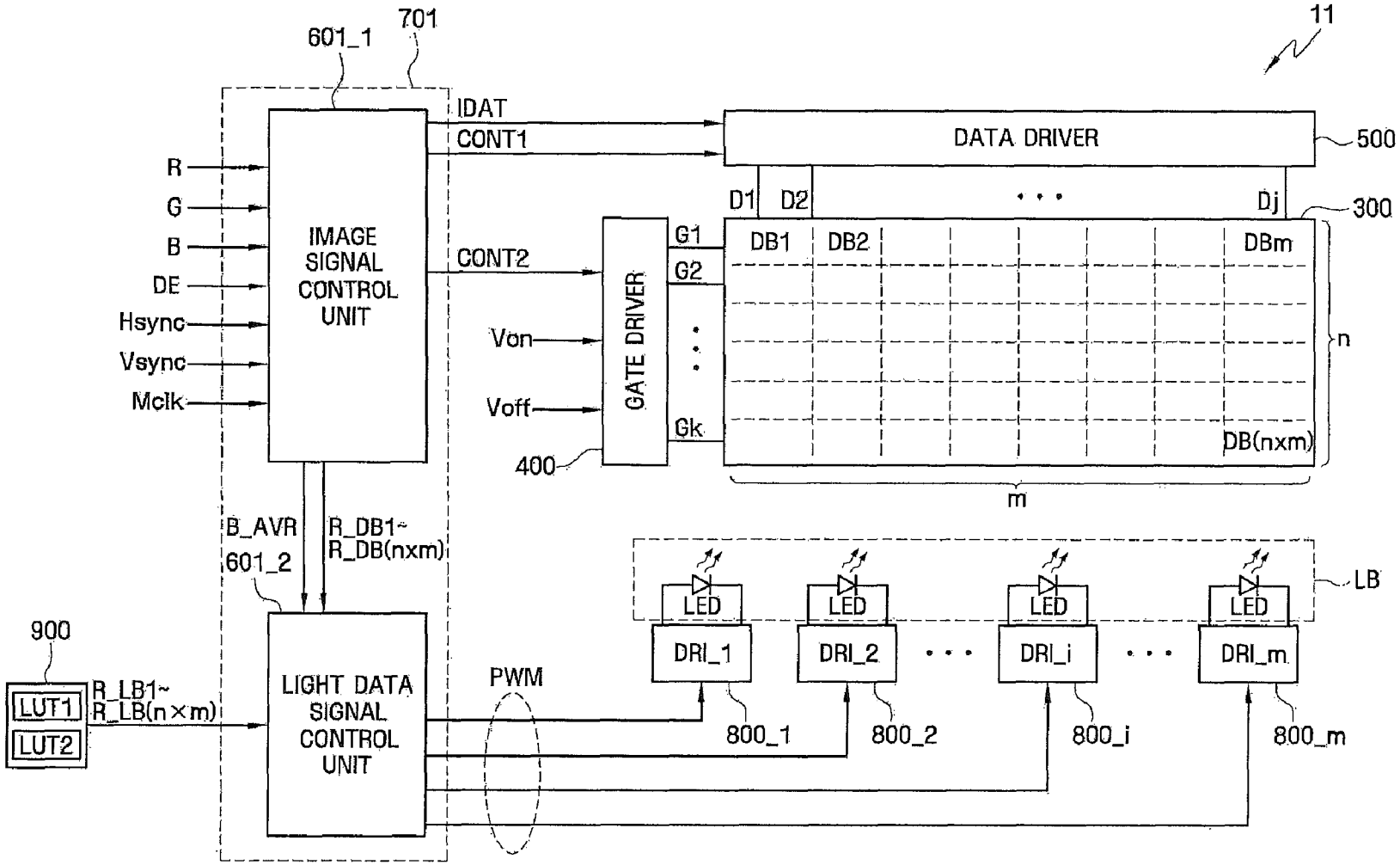
FIG. 10 is a block diagram illustrating a second exemplary embodiment of an LCD according to a second embodiment of the present invention.
Figure 11:
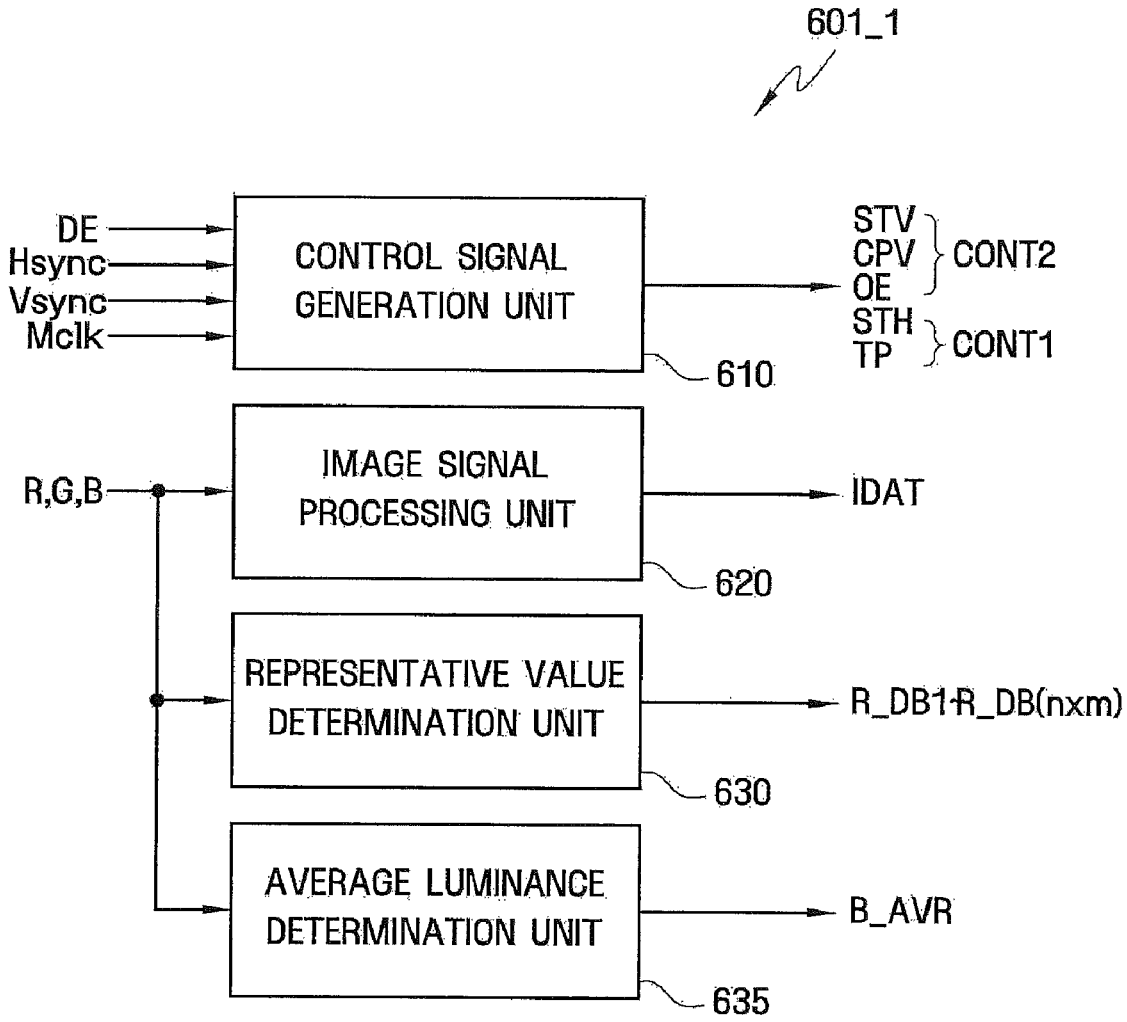
FIG. 11 is a block diagram of an exemplary embodiment of an image signal control unit illustrated in FIG. 10.

Hereinafter, a second exemplary embodiment of an LCD 11 and a second exemplary embodiment of a method of driving the same according to the present invention will be described with reference to FIGS. 10 and 11. FIG. 10 is a block diagram illustrating a second exemplary embodiment of an LCD according to the present invention, and FIG. 11 is an exemplary embodiment of a block diagram of an image signal control unit illustrated in FIG. 10. For brevity, components each having the same function for describing the embodiment shown in FIGS. 1 through 4 are respectively identified by the same reference numerals and their repetitive description will be omitted.

Referring to FIG. 10, unlike in the previous embodiment of the present invention, an image signal processing unit 601_1 averages image signals R, G and B and outputs an average luminance value B_AVR of the image signals R, G and B to a light data signal control unit 601_2. In the previous exemplary embodiment, the averaging function was performed by the light data signal conversion unit 640. The light data signal control unit 601_2 selects one of the first lookup table LUT1 and the second lookup table LUT2 by using the average luminance value B_AVR provided from the image signal processing unit 601_1, reads light data signals R_LB1-R_LB (n×m) corresponding to representative image signals R_DB1-R_DB(n×m) from the selected lookup table, and outputs PWM signals PWM corresponding to the light data signals R_LB1-R_LB(n×m).

More specifically, referring to FIG. 11, in addition to the components described with respect to the previous exemplary embodiment, the image signal control unit 601_1 further includes an average luminance determination unit 635. The average luminance determination unit 635 may receive the image signals R, G and B and determine the average luminance value B_AVR by averaging the image signals R, G and B. The LCD 11 may further include a memory (not shown) which stores a plurality of R, G and B image signals. The average luminance determination unit 635 may store image signals R, G and B of at least a single frame in the memory (not shown) and then determine the average luminance value B_AVR by averaging the stored image signals R, G and B.

Figure 12:
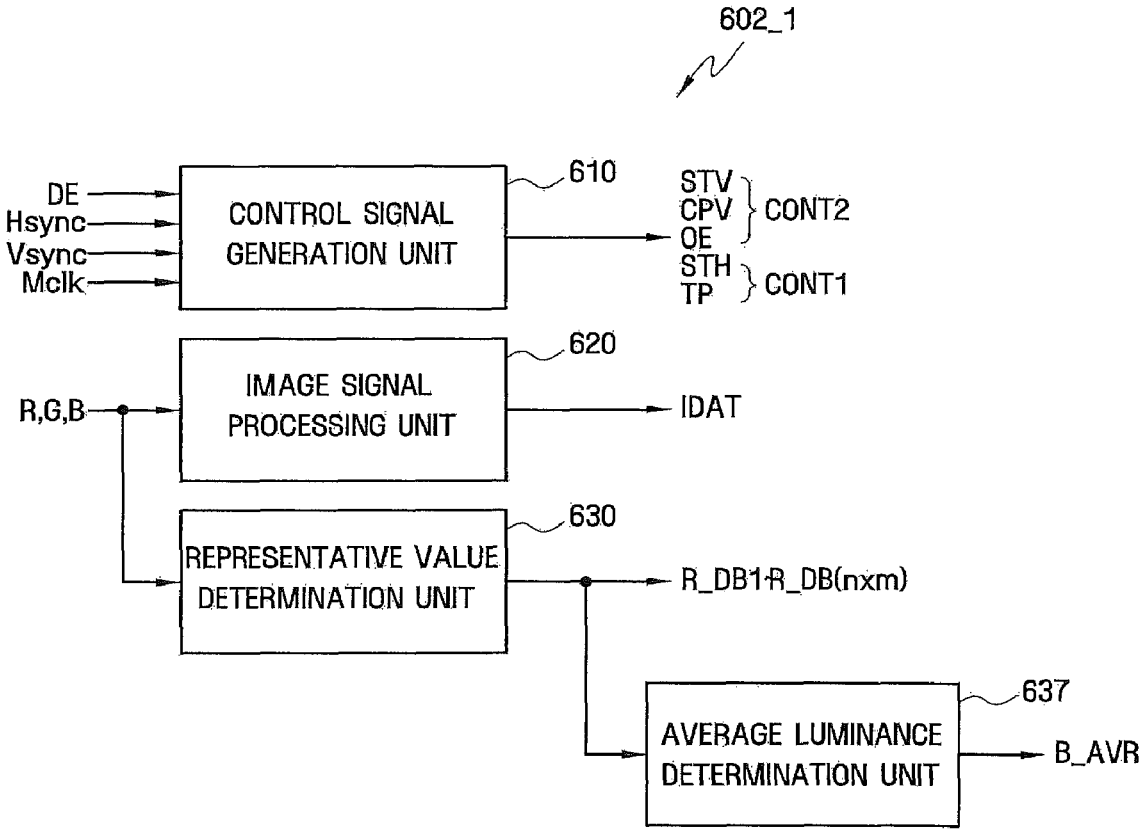
FIG. 12 is a block diagram of a third exemplary embodiment of an image signal control unit according to the present invention.

A description will now be made of a third exemplary embodiment of an LCD according to the present invention with reference to FIG. 12. FIG. 12 is a block diagram of a third exemplary embodiment of an image signal control unit 602_1 according to the present invention. For brevity, components each having the same function as described in the exemplary embodiment shown in FIG. 11 are respectively identified by the same reference numerals and their repetitive description will be omitted.

Referring to FIG. 12, an average luminance determination unit 637 of an image signal control unit 602_1 receives representative image signals R_DB1-R_DB(n×m) output from a representative value determination unit 630 and determines an average luminance value B_AVR of image signals R, G and B by averaging the representative image signals R_DB1-R_DB(n×m). The average luminance determination unit 637 determines the average luminance value B_AVR for the image signals R, G and B and outputs the average luminance value B_AVR to the light data signal control unit 601_2.

Figure 13:
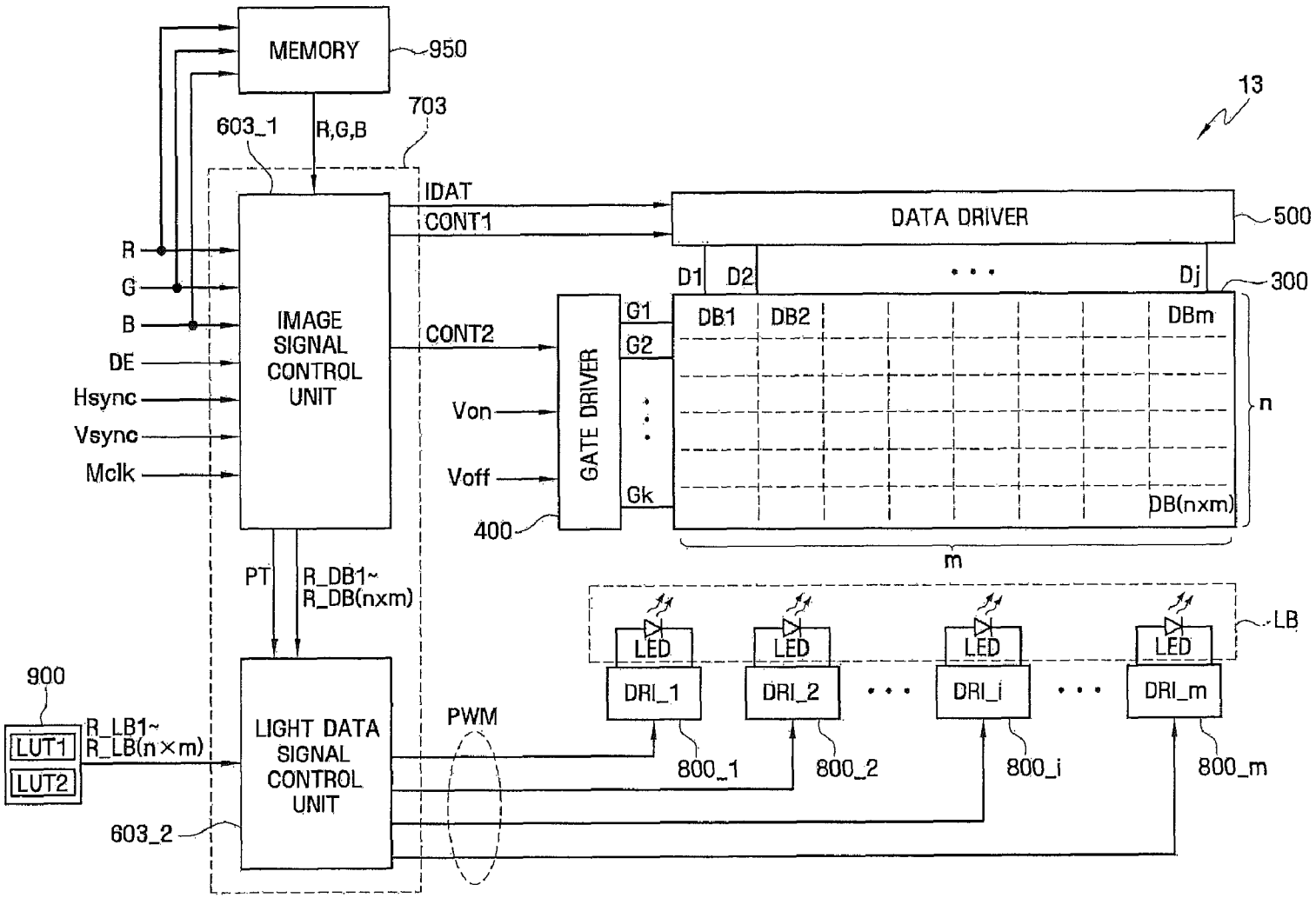
FIG. 13 is a block diagram illustrating a fourth exemplary embodiment of an LCD according to the present invention.

Hereinafter, a fourth exemplary embodiment of an LCD 13 and a method of driving the same according to the present invention will be described with reference to FIG. 13. FIG. 13 is a block diagram illustrating a fourth exemplary embodiment of an LCD according to the present invention. For brevity, components each having the same function as described in the exemplary embodiment shown in FIG. 1 are respectively identified by the same reference numerals and their repetitive description will be omitted.

Referring to FIG. 13, the LCD 13 further includes a memory 950, and a signal control unit 703 of the LCD 13 determines an image pattern and outputs PWM signals PWM according to the image pattern. Exemplary embodiments of the memory 950 may store image signals R, G and B or an image data signal IDAT, however, the following description will be directed towards an embodiment wherein image signals R, G and B are stored.

An image signal control unit 603_1 determines an image pattern using the image signals R, G and B stored in the memory 950. For example, the image signal control unit 603_1 may determine the gray levels of the image signals R, G and B stored in the memory 950, determine the number of R, G, and B image signals for each gray level, and then determine the image pattern according to the number of R, G, and B image signals for each gray level. However, the image signal control unit 603_1 may also determine the image pattern by using other methods, and output an image pattern signal PT to a light data signal control unit 603_2, wherein the image pattern signal PT is the determination of the image pattern by the image signal control unit 603_1.

For example, when the image signals R, G and B are image signals corresponding to small white dots displayed on a dark background, similar to the starry night image described above, the number of image signals R, G and B having low gray levels may be large and the number of image signals R, G and B having high gray levels may be very small. As such, by determining the number of image signals R, G and B for each gray level, the image signal control unit 603_1 may determine an image pattern of the image signals R, G and B and provide the image pattern signal PT that is the determination result to the light data signal control unit 603_2.

The light data signal control unit 6032 may receive the image pattern signal PT and the representative image signals R_DB1-R_DB(n×m) to select one of the first lookup table LUT1 and the second lookup table LUT2 according to the image pattern signal PT, and read the light data signals R_LB1-R_LB(n×m) corresponding to the representative image signals R_DB1-R_DB(n×m) from the selected lookup table. The light data signal control unit 603_2 outputs PWM signals PWM corresponding to the read light data signals R_LB1-R_LB(n×m).

In summary, the signal control unit 703 determines an image pattern to select one of the first lookup table LUT1 and the second lookup table LUT2 and reads the light data signals R_LB1-R_LB(n×m) from the selected lookup table, thereby improving display quality.

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims rather than the foregoing description to indicate the scope of the invention.

What is claimed is:

1. A display device comprising:

a signal control unit which receives a plurality of image signals and determines a plurality of representative image signals from the image signals;

a plurality of lookup tables, each of which is configured to store a plurality of light data signals corresponding to the plurality of representative image signals;

a plurality of light-emitting blocks configured to provide light according to the respective light data signals; and a display panel configured to display an image corresponding to the plurality of image signals, wherein the signal control unit determines an average luminance value of the plurality of image signals, selects one of the plurality of lookup, tables according to the determined average luminance value, reads the light data signals from the selected lookup table and provides the light data signals to at least one of the plurality of light emitting blocks to drive the at least one of the plurality of light emitting blocks.

2. The display device of claim 1, wherein the signal control unit provides a light data signal corresponding to a margin gray level to the at least one of the plurality of light emitting blocks if a gray level of the representative image signal is lower than the margin gray level.

3. The display device of claim 1, wherein the signal control unit selects a first lookup table if the average luminance value is greater than a reference luminance value, and selects a second lookup table if the average luminance value is less than the reference luminance value, wherein a gray level of a first light data signal selected from the first lookup table is equal to or lower than a corresponding second light data signal selected from the second lookup table and the first and second light data signals correspond to each of the representative image signals.

4. The display device of claim 1, wherein the signal control unit determines the average luminance value of the plurality of representative image signals by averaging the plurality of representative image signals.

5. The display device of claim 1, wherein the signal control unit comprises:

an image signal control unit receiving the plurality of image signals, determining a plurality of representative image signals, and outputting the plurality of representative image signals; and a light data signal control unit receiving the plurality of representative image signals to determine the average luminance value, selecting one of the plurality of lookup tables according to the determined average luminance value, and reading the light data signals from the selected lookup table.

6. The display device of claim 1, wherein the signal control unit determines an image pattern of the plurality of image signals and provides the light data signals corresponding to the representative image signals according to the determined image pattern.

7. The display device of claim 6, wherein each of the plurality of image signals has a gray level and the image pattern is determined by determining the number of image signals having each gray level.

8. The display device of claim 6, further comprising a memory storing the plurality of image signals, wherein the signal control unit determines the image pattern using the image signals stored in the memory, selects one of the plurality of lookup tables according to the determined image pattern, and reads the light data signals from the selected lookup table.

9. The display device of claim 8, wherein the signal control unit comprises:

an image signal control unit receiving the plurality of image signals, determining a plurality of representative image signals, outputting the plurality of representative image signals, determining the image pattern, and outputting an image pattern signal; and a light data signal control unit selecting one of the plurality of lookup tables according to the image pattern signal and reading the light data signals corresponding to the representative image signals from the selected lookup table.

10. The display device of claim 1, wherein the display panel is divided into a plurality of display blocks corresponding to the plurality of light-emitting blocks and each of the representative image signals is an average value of the plurality of image signals provided to each of the display blocks.

11. The display device of claim 1, wherein the light data signals corresponding to the representative image signals, as derived from a first gamma curve, are stored in a first lookup table, and the light data signals corresponding to the representative image signals, as derived from a second gamma curve, are stored in a second lookup table.

12. A method of driving a display device, the method comprising:

receiving a plurality of image signals and determining a plurality of representative image signals;

providing a plurality of light data signals corresponding to the plurality of representative image signals according to an average luminance value of the plurality of image signals by selecting one of a plurality of lookup tables storing the plurality of light data signals corresponding to the plurality of representative image signals and reading the light data signals from the selected lookup table;

providing the light data signals to at least one of the plurality of light emitting blocks to drive the at least one of the plurality of light emitting blocks; and displaying an image corresponding to the plurality of image signals.

13. The method of claim 12, wherein the providing the plurality of light data signals comprises providing a light data signal corresponding to a margin gray level when a gray level of the representative image signal is lower than the margin gray level.

14. The method of claim 12, wherein the average luminance value is an average value of the plurality of representative image signals.

15. The method of claim 12, wherein the providing the light data signals comprises determining an image pattern of the plurality of image signals and providing the light data signals corresponding to the representative image signals according to the determined image pattern.

16. The method of claim 15, wherein each of the plurality of image signals has a gray level and the determining the image pattern is performed by determining the number of image signals having each gray level.

17. The method of claim 15, wherein the determining of the image pattern of the plurality of image signals comprises storing the plurality of image signals in a memory and determining a gray level of each of the plurality of image signals using the stored plurality of image signals.

18. The method of claim 12, wherein the light data signals corresponding to the representative image signals, as derived from a first gamma curve, are stored in a first lookup table, and the light data signals corresponding to the representative image signals, as derived from a second gamma curve, are stored in a second lookup table.

* * * * *